US005851316A

United States Patent [19]

Yazawa et al.

[11] Patent Number: 5,851,316

[45] Date of Patent: Dec. 22, 1998

[54] FERRITE STAINLESS STEEL SHEET HAVING LESS PLANAR ANISOTROPY AND EXCELLENT ANTI-RIDGING CHARACTERISTICS AND PROCESS FOR PRODUCING SAME

[75] Inventors: Yoshihiro Yazawa; Takumi Ujiro; Susumu Satoh; Shintaro Kumazawa; Makoto Kobayashi; Masayuki Kasai, all of Chiba, Japan

[73] Assignee: Kawasaki Steel Corporation, Japan

[21] Appl. No.: 719,401

[22] Filed: Sep. 24, 1996

[30] Foreign Application Priority Data

Sep. 26, 1995 [JP] Japan ..... 7-247770
Apr. 26, 1996 [JP] Japan ..... 8-107289

[51] Int. Cl.[6] ..... C22C 38/00; C22C 38/18; C22C 38/22; C22C 38/32

[52] U.S. Cl. ..... 148/325; 148/320; 148/579; 148/605; 428/544; 420/121; 420/64

[58] Field of Search ..... 428/544, 681, 428/666; 420/34, 8, 67, 60, 61, 62, 63, 68, 71, 90, 91, 93, 103, 123, 124, 126, 64, 121; 148/320, 325, 332, 336, 579, 605, 625, 648, 654, 660, 662

[56] References Cited

U.S. PATENT DOCUMENTS

| | | | |
|---|---|---|---|
| 3,953,201 | 4/1976 | Wood et al. | 75/126 C |
| 4,331,474 | 5/1982 | Espy et al. | 75/124 |
| 4,408,709 | 10/1983 | Devine, Jr. | 228/183 |
| 4,690,798 | 9/1987 | Narutani et al. | 420/61 |
| 5,049,210 | 9/1991 | Miyasaka et al. | 428/586 |
| 5,110,544 | 5/1992 | Sato et al. | 420/69 |
| 5,383,983 | 1/1995 | Kondo et al. | 148/325 |
| 5,512,239 | 4/1996 | Fujiwara et al. | 420/68 |
| 5,681,528 | 10/1997 | Martin et al. | 420/53 |

FOREIGN PATENT DOCUMENTS

| | | |
|---|---|---|
| 0 435 003 A1 | 7/1991 | European Pat. Off. . |
| 0 675 206 A1 | 10/1995 | European Pat. Off. . |
| 2 263 309 | 10/1975 | France . |
| 52-717 | 1/1977 | Japan . |
| 2 070 644 | 9/1981 | United Kingdom . |

*Primary Examiner*—John J. Zimmerman
*Assistant Examiner*—Michael LaVilla
*Attorney, Agent, or Firm*—Austin R. Miller

[57] ABSTRACT

A ferritic stainless steel sheet having less planar anisotropy and excellent anti-ridging characteristics is disclosed. The sheet includes not more than about 0.02 wt % of C, about 0.01–1.0 wt % of Si, about 0.01–1.0 wt % of Mn, not more than about 0.08 wt % of P, not more than about 0.01 wt % of S, about 0.005–0.30 wt % of Al, about 11–50 wt % of Cr, about 0.1–5.0 wt % of Mo, not more than about 0.03 wt % N, with the contents of C and N satisfying the relations: about 0.005 wt %≦(C+N)<about 0.03 wt %, and (C/N) <about 0.6. The sheet also includes Ti in an amount to satisfy the relation: about 5≦Ti/(C+N)≦about 30. The balance of the sheet includes Fe and incidental impurities, with the sheet having an X-ray integral intensity ratio (222)/(310) of not less than about 35 in a plane parallel to a sheet surface at a depth of ¼ of the sheet thickness from the sheet surface. This ferritic stainless steel sheet may be produced by a method which includes hot rolling said steel having the above-described composition at a final pass reduction ratio during rough rolling of not less than about 40% and at a final finish rolling temperature of not more than about 750° C. The hot rolled sheet is subsequently annealed, cold rolled, and finish annealed.

2 Claims, 4 Drawing Sheets

FERRITE STAINLESS STEEL SHEET HAVING LESS PLANAR ANISOTROPY AND EXCELLENT ANTI-RIDGING CHARACTERISTICS AND PROCESS FOR PRODUCING SAME

BACKGROUND OF THE INVENTION

1. Field of the Invention

This invention relates to a ferrite stainless steel sheet appropriate for use in facing materials of buildings, kitchen utensils, chemical plants, and water storage tanks, and more particularly relates to a ferrite stainless steel sheet (including steel strip) having less planar anisotropy and excellent anti-ridging characteristics, the invention including a method of production.

2. Description of the Prior Art

Stainless steel sheets have a beautiful surface and excel in resistance to corrosion and, therefore, are commonly used as facing materials for buildings, kitchen utensils, chemical plants, and water storage tanks, for example. Particularly, austenitic stainless steel has been widely used in such applications because it is superior to ferritic stainless steel in terms of press formability, ductility, and anti-ridging characteristics.

In recent years, steelmaking technology for high purity steel production has advanced to the point where product steels can exhibit enhanced formability, etc. Thus, the feasibility of applying highly corrosion resistant, high purity ferritic stainless steel in applications conventionally dominated by austenitic stainless steel such as SUS 304 and SUS 316 has been investigated. These studies have been prompted by ferritic stainless steel's advantageously low susceptibility to stress corrosion cracking and its lower cost due to the lack of Ni, an expensive substance typically present in austenitic stainless steels.

Ferritic stainless steel, however, has rarely been considered for use as a durable consumable material for which corrosion resistance is of primary importance. For ferritic stainless steel to be used more frequently, it must exhibit adequate planar anisotropy and additional improvements in workability.

For the purpose of improving the workability of ferritic stainless steel, a method which lowers the (C+N) content of the steel is known in the art. JP-A-56-123,327 discloses a technique for optimizing the draft distribution and the annealing condition for a ferritic stainless steel which has incorporated therein such a carbon and nitrogen stabilized element such as Nb. JP-A-03-264,652 discloses a technique for improving the forming properties of a ferritic stainless steel such as elongation and r value (Rankford value) by adding carbon and nitrogen stabilized elements like Ti and Nb to the stainless steel, thereby controlling the texture of aggregation and heightening the X ray integral intensity ratio (222)/(200). Further, JP-B-54-11,770 discloses a technique for improving the cold workability of a ferritic stainless steel by decreasing the C and N contents and, at the same time, adding Ti.

These known techniques, however, are directed chiefly to improving the r value and the ductility. While they are apparently effective in improving these properties, the product ferritic stainless steels exhibit large planar anisotropy and do not possess satisfactory anti-ridging characteristics.

In applications like stamping that demand deep drawing ferritic stainless steel having improved planar anisotropy and anti-ridging characteristics would enhance the appearance and thus would advantageously reduce the polishing and other cosmetic work otherwise required.

SUMMARY OF THE INVENTION

In light of these shortcomings of prior art ferritic stainless steels, an object of the present invention is to provide a ferritic stainless steel sheet having less planar anisotropy and excellent anti-ridging characteristics, as well as a method for producing the same.

A further object of this invention is to provide a ferrite stainless steel sheet having a r value of not less than about 1.4, an elongation of not less than about 30%, a planar anisotropy, Δr, of not more than about 0.2 for the r value, a planar anisotropy, ΔEl, of not more than about 2.0% for the elongation, and an undulating height (which will be described below) of not more than about 10 μm, combined with excellent anti-ridging characteristics, and a method for producing the same.

The present inventors have discovered that these objects are achieved by carefully controlling the chemical composition, rolling conditions, and annealing conditions of a ferritic stainless steel, thereby permitting the ferritic stainless steel to attain a unique texture of aggregation.

To be specific, this invention has the following essential elements.

A ferritic stainless steel sheet having less planar anisotropy and excellent anti-ridging characteristics in accordance with the invention comprises not more than about 0.02 wt % of C, about 0.01–1.0 wt % of Si, about 0.01–1.0 wt % of Mn, not more than about 0.08 wt % of P, not more than about 0.01 wt % of S, about 0.005–0.30 wt % of Al, about 11–50 wt % of Cr, about 0.1–5.0 wt % of Mo, not more than about 0.03 wt % N, C and N satisfying the relations about 0.005 wt % $\leqq$(C+N)$\leqq$about 0.03 wt % and (C/N)<about 0.6. The ferritic stainless steel further comprises Ti in an amount which satisfies the relation about 5$\leqq$Ti/(C+N)<about 30, with the balance of the ferritic stainless steel being Fe and incidental impurities. The ferritic stainless steel has an X-ray integral intensity ratio (222)/(310) of not less than about 35 in a plane parallel to the sheet surface at a depth of about ¼ of the sheet thickness from a sheet surface.

Preferably not less than about 80% of the sheet in the thickness direction possesses an X-ray integral intensity ratio (222)/(310) within ±40% of the average X-ray integral intensity ratio (222)/(310) in the thickness direction.

The invention also embodies a method of producing a ferritic stainless steel sheet, wherein a steel having the above-described composition is hot rolled with a final pass of the rough rolling reduction ratio of not less than about 40% a final finish rolling temperature of not more than about 750° C. to produce a hot rolled sheet. The hot rolled sheet, which preferably possesses an X ray integral intensity ratio (222)/(310) of not less than about 30 in a plane parallel to the sheet surface at a depth of about ¼ of the sheet thickness from a sheet surface, is subsequently subjected to hot roll annealing, cold rolling, and finish annealing.

Other elements and equivalents of this invention will become apparent from the following detailed description.

DETAILED DESCRIPTION OF THE INVENTION

Figure 1:
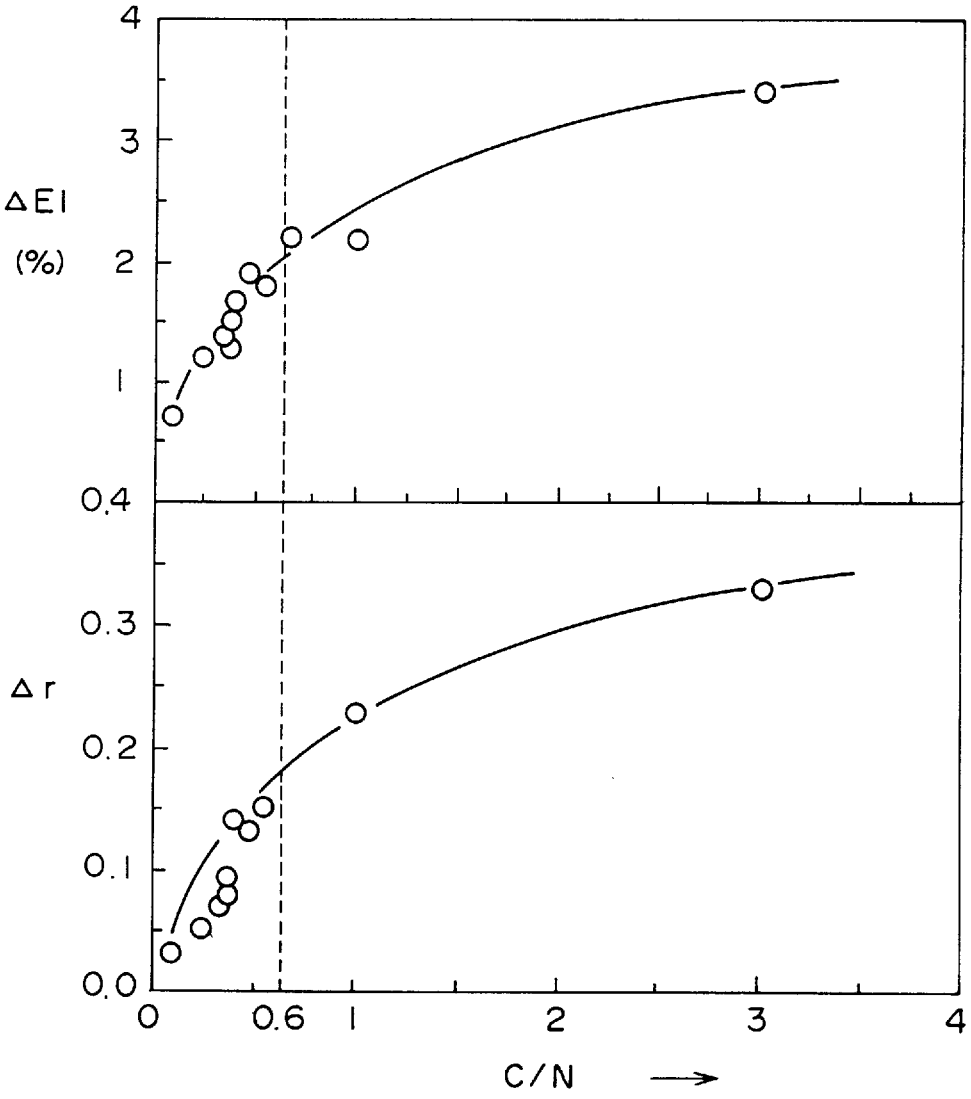
FIG. 1 is a graph showing the relation between planar anisotropy in terms of ΔEl and Δr and the C/N content ratio of the steel.

This invention will be described more specifically below with reference to the contents of the components of the steel.

C: Not more than about 0.02 wt %

C is an element which generally lowers the r value, represses elongation and weakens corrosion resistance. The upper limit of the content of C is about 0.02 wt % because these adverse effects become conspicuous above the content. Preferably, C content is not more than about 0.005 wt %.

Si: Between about 0.01 and 1.0 wt %

Si is an element which promotes deoxidation, when the Si content is not less than 0.01 wt %. The upper limit of the Si content, however, is about 1.0 wt %. Contents in excess of about 1.0 wt % can impair cold workability and degrade ductility. Preferably, the Si content is in the range of about 0.03–0.5 wt %.

Mn: Between about 0.01 and 1.0 wt %

Mn is useful for separating S from steel and fixing the separated S and to maintain hot workability, when the Mn content is not less than 0.01 wt %. The upper limit of Mn content is about 1.0 wt % because additional quantities lower cold workability and degrade corrosion resistance. Preferably, the Mn content is in the range of about 0.1–0.5 wt %.

P: Not more than about 0.08 wt %

P is a harmful element which not only degrades hot workability but also deteriorates mechanical properties. The upper limit of P content is about 0.08 wt % because the adverse effects of this element become conspicuous when the content exceeds about 0.08 wt %. Preferably, P content is not more than about 0.04 wt %.

S: Not more than about 0.01 wt %

S is a harmful element which couples with Mn to form rust-promoting MnS and, at the same time, segregates in the grain boundary and promotes the embrittlement of grain boundary. The upper limit of the S content, therefore, is about 0.01 wt % because the adverse effects of this element become conspicuous when the content exceeds about 0.01 wt %. Preferably, S content is not more than about 0.006 wt %.

Al: Between about 0.005 and 0.30 wt %

Al is an element which promotes deoxidation, when the Al content is not less than 0.005 wt %. The upper limit of Al content is about 0.30 wt % because additional quantities of this element promote Al-based inclusions which induce surface flaws. The Al content is preferably in the range of about 0.005–0.10 wt %.

Cr: Between about 11 and 50 wt %

Cr is an element which is indispensable to the improvement of corrosion resistance. The Cr content is in the range of about 11–50 wt % because sufficient corrosion resistance will not be realized if the content is less than about 11 wt %, while hot and cold workability will be degraded if the content exceeds about 50 wt %. The Cr content preferably is in the range of about 11 to 35 wt %.

Mo: Between about 0.1 and 5.0 wt %

Mo is an element which improves corrosion resistance and anti-ridging characteristics, when the Mo content is not less than 0.1 wt %. The upper limit of the Mo content is about 5.0 wt % because the corrosion and rusting resistance effects are saturated, and precipitation of the a phase and the χ phase is promoted to degrade corrosion resistance and workability when the Mo content exceeds about 5.0 wt %. Mo content is preferably not less than about 0.1 wt % to ensure the beneficial effects described above.

N: Not more than about 0.03 wt %

N, like C, is harmful to corrosion resistance because it lowers the r value, represses elongation, and forms a Cr-removing layer through the formation of a Cr nitride. The upper limit of the N content is about 0.03 wt % because the adverse effects of the element become conspicuous when the N content exceeds about 0.03 wt %. Preferably, the N content is not more than about 0.01 wt %.

about 0.005 wt %≦(C+N)≦about 0.03 wt %, (C/N) <about 0.6

C and N, as described above, both have adverse effects on the r value, elongation, and corrosion resistance. If the total content of C and N exceeds about 0.03 wt %, these negative effects will become conspicuous. Conversely, if the combined content of C and N is less than about 0.005 wt %, a preferential growth of crystal grains will be promoted, controlling the aggregation texture becomes difficult, and anti-ridging characteristics is degraded. The C content and the N content, therefore, must satisfy the expression, about 0.005 wt %≦(C+N)≦about 0.03 wt %.

We have also discovered that the weight ratio of C and N, (C/N), has a large effect on the aggregation texture. If (C/N) is less than about 0.6, the numerical value of the X-ray integral intensity ratio (222)/(310) will increase, the r value and the elongation will be improved, and the magnitude of planar anisotropy will decrease. The C content and the N content, therefore, must also satisfy the relation, (C/N) <about 0.6.

FIG. 1 shows the relation between planar anisotropy (to be determined by the method which will be described herein below) and C/N, obtained from various species of steel sheets having the C+N in the range of 0.0080–0.0200 wt %, Ti/(C+N) in the range of 10–19, and the other elements in accordance with the present invention. FIG. 1 shows that the C/N must be less than about 0.6 to decrease the planar anisotropy as required.

about 5≦Ti/(C+N)≦about 30

Ti is a carbon and nitrogen stabilized element which is useful for repressing the precipitation at the grain boundaries of Cr carbides and/or nitrides during the course of welding or heat treatment. Ti also improves corrosion resistance, fixes the solid solution of C and N in steel in the form of a carbides and/or nitrides, controls the texture of aggregation, and improves ductility and workability.

These effects will not be obtained if the weight ratio of Ti to (C+N), i.e. Ti/(C+N), is less than about 5. Conversely, if this ratio exceeds about 30, these properties will be degraded. Thus, Ti and C and N must satisfy the relation, about 5≦Ti/(C+N)≦about 30.

The composition of the ferritic stainless steel of this invention may also include, besides the elements mentioned above, at least one member of at least one group selected from the following three groups:

(1) Ca: About 0.0005–0.0050 wt %, (2) Nb: About 0.001–0.0100 wt %, B: About 0.00020–0.0020 wt %, (3) Cu: About 0.01–2.0 wt %, Ni: About 0.01–2.0 wt %.

Ca: Between about 0.0005 and 0.0050 wt %

Ca effectively represses the nozzle clogging caused by Ti-based inclusions during the casting of steel, when the Ca content is not less than about 0.0010 wt %. The Ca content, however, must have its upper limit of about 0.0050 wt % because excess addition of this element can induce rusting, with a Ca-based inclusions acting as the starting point, and consequently promote fracture by embrittlement. The Ca content is preferably in the range of about 0.0010–0.0030 wt %.

Nb: Between about 0.001–0.0100 wt %

Nb is a carbon and nitrogen element which effectively enhances corrosion resistance and workability and, in particular, enhances planar anisotropy for improved mechanical characteristics, when the Nb content is not less than about 0.001 wt %. If Nb is added in an amount exceeding about 0.0100 wt %, however, the effect mentioned above will be saturated and the workability will be degraded as the temperature of recrystallization rises. The upper limit of Nb content, therefore, is about 0.0100 wt %. For the purpose of manifesting the effect of producing minute carbide particles in steel, refining crystal grains, and improving planar anisotropy, it is preferred that Nb content is between about 0.003 and 0.008 wt %.

B: Between about 0.00020 and 0.0020 wt %

B is a useful element which precipitates in the crystal grain boundaries and improves the secondary work embrittlement of steel, when the B content is not less than about 0.00020 wt %. The upper limit of B content is about 0.0020 wt % because contents in excess of about 0.0020 wt % impair workability. Preferably, B content is in the range of about 0.0003–0.0010 wt %.

Cu: Between about 0.01 and 2.0 wt %

Cu is a useful element which improves resistance to corrosion, caused by acid, and the crevice corrosion resistance, when the Cu content is not less than 0.01 wt %. The element is also effective in restraining the growth of pits destined to become initial rusting points, thereby improving the corrosion resistance. Cu is useful for imparting improved corrosion resistance to such consumer articles as building materials and kitchen utensils, for example. The upper limit of the Cu content is about 2.0 wt % because Cu contents exceeding about 2.0 wt % will bring about adverse effects like cracking at high temperatures. Preferably, Cu content is in the range of about 0.1–2.0 wt %.

Ni: Between about 0.01 and 2.0 wt %

Ni is also a useful element which improves the resistance to corrosion, caused by acid, and the crevice corrosion resistance, when the Ni content is not less than 0.01 wt %. The element is also effective in restraining the growth of pits destined to become initial rusting points, thereby improving the corrosion resistance. Ni is useful for imparting improved corrosion resistance to such consumer articles as building materials and kitchen utensils, for example. The upper limit of Ni content nevertheless is about 2.0 wt % because Ni contents in excess of about 2.0 wt % will bring about adverse effects such as cracking at high temperatures. Preferably, Ni content is in the range of about 0.1–2.0 wt %.

For the purpose of improving the corrosion resistance, it is preferred that the total content of Cu and Ni is not less than about 0.01 wt %.

X-ray integral intensity ratio: (222)/(310) (hereinafter expressed as "α")

An increase in the X-ray integral intensity ratio: α=(222)/(310) (which will be described specifically herein below) in a plane of a rolled steel sheet parallel to the sheet surface serves reflects a decrease in the ratio of planar anisotropy such as for Δr and ΔEl without negatively affecting the r value and the elongation. To secure this advantageous effect, the ratio of α in a plane of a hot rolled sheet parallel to the sheet surface at a depth of about ¼ of the thickness of the sheet is controlled to a level exceeding about 30. When a hot rolled sheet having an aggregation texture controlled as described above is subjected to hot rolled sheet annealing, cold rolling, and cold rolled sheet annealing, a ferritic stainless steel sheet having the ratio of α at depth of about ¼ of the thickness of the sheet in a plane parallel to the sheet surface will ultimately exhibit an a exceeding about 35.

Figure 2:
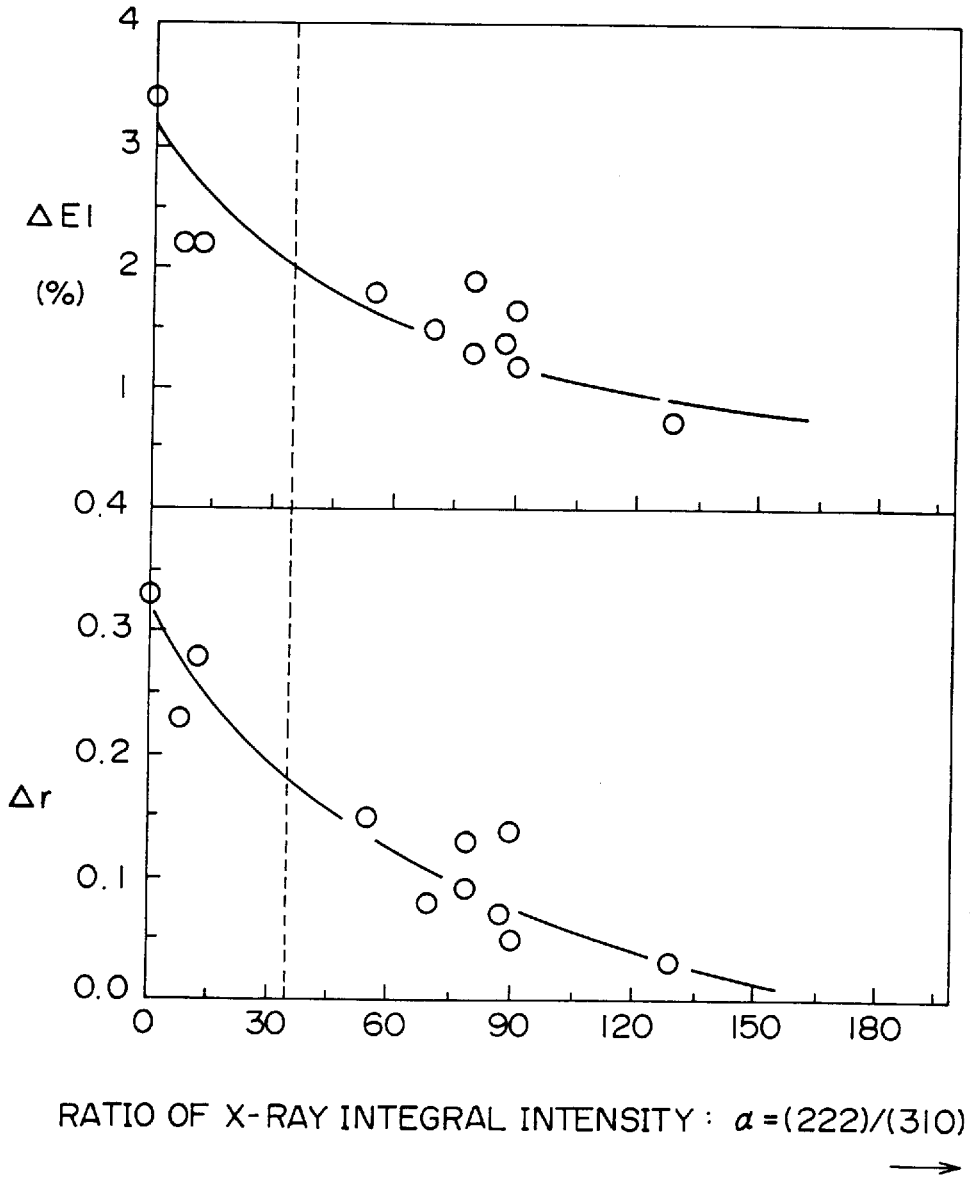
FIG. 2 is a graph showing the relation between planar anisotropy in terms of ΔEl and Δr and the X-ray integral intensity ratio [α=(222)/(310)].

FIG. 2 represents the relation between planar anisotropy (to be determined by the method which will be described herein below) and the ratio of α at the depth of about ¼ of the thickness of rolled sheet, obtained from cold rolled steel sheets manufactured by subjecting various species of steels having C+N total percentages in the range of 0.0080–0.0200 wt %, the Ti/(C+N) ratio in the range of 10–19, and the other elements in accordance with the invention to hot rolling, annealing, and cold rolling performed under varied conditions. FIG. 2 shows that the ratio of α in a cold rolled sheet must be controlled to a level of not less than about 35, preferably to a level of not less than about 75, for the purpose of lowering both the elongation planar anisotropy ΔEl and the r value planar anisotropy Δr.

The depth of about ¼ of the thickness in the direction of sheet thickness is adopted as the position for the determination of the X-ray integral intensity ratio α, because it has a good relation with the planar anisotropy and is most representative of the numerical values of α existing throughout the entire body of the steel sheet.

It has been discovered that the degree to which the reduction in both types of planar anisotropy ΔEl and Δr is retained increases as the ratio of the X-ray integral intensity ratio a increases, and also increases in proportion to improved uniformity in the ratio of α in the sheet thickness direction.

Figure 3:
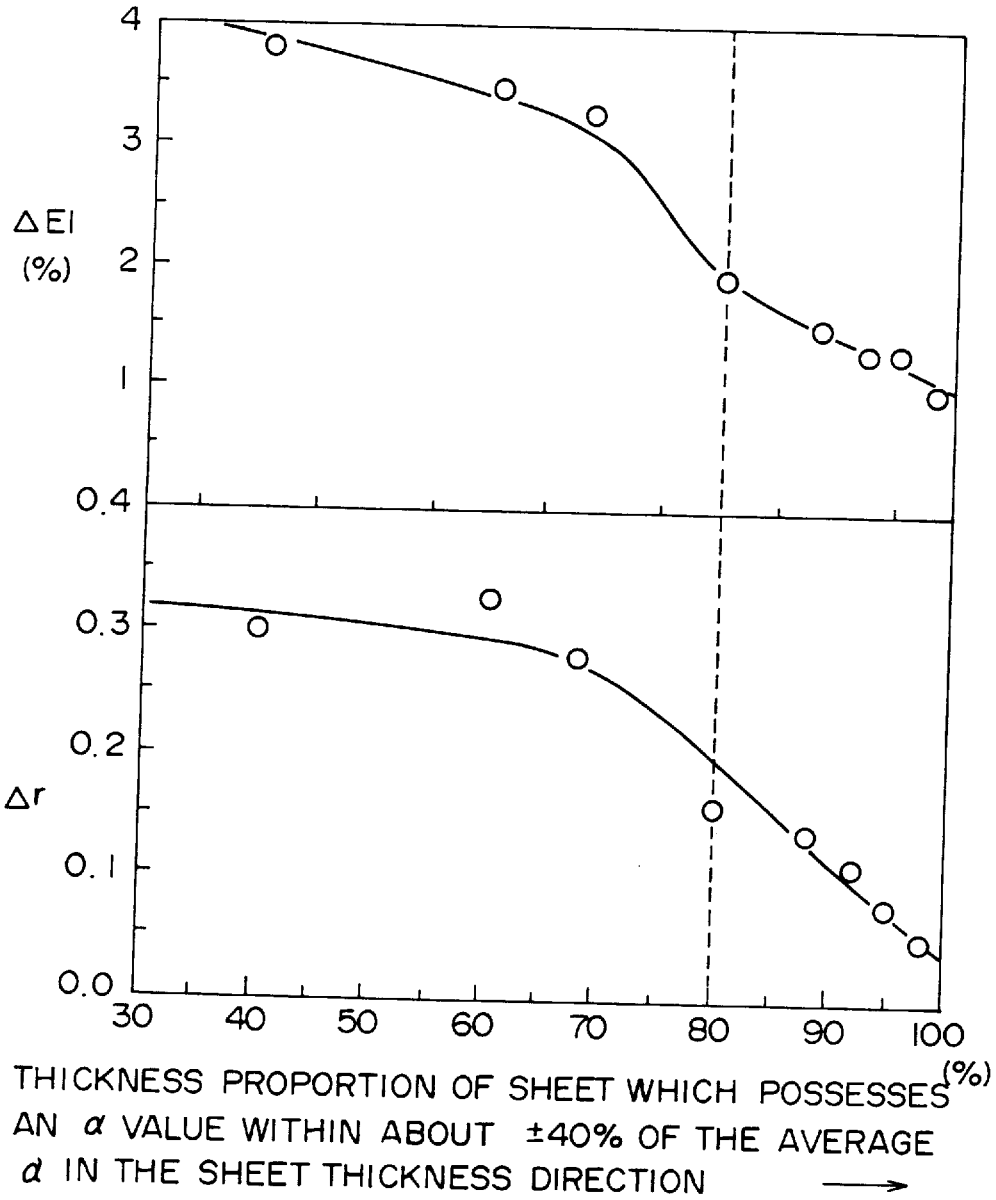
FIG. 3 is a graph showing the relation between the thickness proportion of the sheet which possesses an α [α=(222)/(310)] within about ±40% of the average α in the sheet thickness direction to the sheet thickness and planar anisotropy in terms of ΔEl and Δr.

The data of FIG. 3 were obtained by preparing steel sheets whose ratio of α at a depth of ¼ of the sheet thickness in a cold rolled sheet were in the range of 50–130, measuring the ratio of α in the direction of sheet thickness at various depths, calculating the average α in the thickness direction, then calculating the thickness proportion of the sheet which possesses an α within ±40% of the average α in the sheet thickness direction. The relation between the proportions mentioned above and both types of planar anisotropy ΔEl and Δr is shown in FIG. 3.

Figure 4:
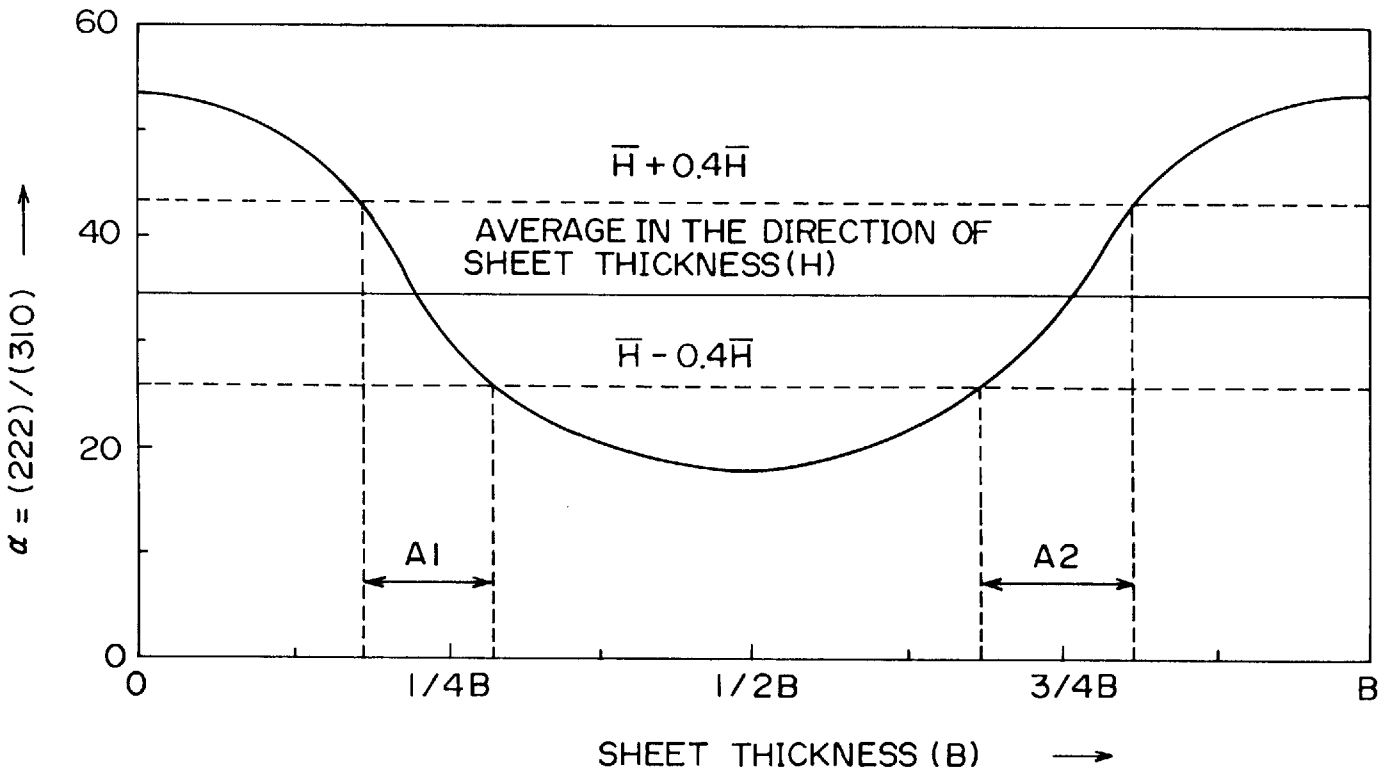
FIG. 4 is a diagram describing the method for determining the thickness proportion of the sheet which possesses an α [α=(222)/(310)] within about ±40% of the average a in the sheet thickness direction.

The method for specifically calculating the ratio of the X-ray integral intensity ratio α mentioned above will is schematically shown in FIG. 4. First, a distribution curve in the direction of sheet thickness is found by measuring the ratio of α at varying positions either separated at intervals of not more than 100 μm or selected at not less than 30 points, integrating this distribution curve in the direction of sheet thickness, and dividing the results of this integration by the sheet thickness B to thereby calculate the average of the ratio α of the X-ray integral intensity ratio in the direction of sheet thickness. Then, the lengths in the direction of sheet thickness (the total length of the line segment, A1+A2, in the diagram) in the area existing within about ±40% of the average are found and the ratio of the lengths to the sheet thickness {(A1+A2)/B}×100 (%) are calculated.

FIG. 3 shows that the planar anisotropy can be decreased by controlling the thickness proportion of the sheet having an α within about ±40% of the average α in the sheet thickness direction to not less than about 80%.

A method for producing a steel sheet in accordance with the invention comprises melting a steel having a composition specified above in, e.g., a converter or an electric furnace, forming slabs from the melt by a continuous casting method or a molding method, and subjecting the slabs sequentially to the steps of hot rolling, annealing of hot rolled sheet, pickling, cold rolling, and finish annealing. These steps are described in detail below.

Hot rolling

The reduction ratio of hot rolling is closely related to the separation of a ferrite band which is thought to be an important factor in ridging. In particular, we have discovered that when the final pass reduction ratio during rough rolling exceeds about 40%, separation of the ferrite band is ensured, strain in the sheet thickness direction is made uniform, and the refinement of crystal grains by static recrystallization is effectively promoted.

Further, the final temperature of the finish rolling has effects similar to the reduction ratio in the rough rolling mentioned above. The degree with which the uniformity, refinement, and isotropy of the crystal grains in the direction of sheet thickness are promoted by the residue of the rolling strain of increases as the final temperature of the finish rolling lowers. The upper limit of the final finish rolling temperature is set at about 750° C. because the effects mentioned above are large by lowering the final temperature below about 750° C. If the final temperature is less than about 600° C., surface defects will occur easily and the productivity will be degraded. Therefore, the lower limit of the final temperature is preferably about 600° C.

The application of a lubricant to the place between the sheet and work rolls during hot rolling in the low temperature range mentioned above for the purpose of imparting uniform strain in the direction of sheet thickness is advantageous because the lubrication promotes static recrystallization caused by accumulation of strain.

Annealing of hot rolled sheet

The annealing conditions for the hot rolled sheet affect ridging. If the annealing temperature of the hot rolled sheet is too low, ridging will occur in the form of a band. If this temperature is too high, the surface of the rolled steel sheet will exhibit a rough skin. The range of this annealing temperature, therefore, is about 900°–1100° C., preferably about 975°–1050° C. The annealing time is preferably in the range of about 5 seconds–4 minutes.

Cold rolling

The reduction ratio of the cold rolling affects ridging, the r value, and planar anisotropy. The r value and anti-ridging characteristics are improved and planar anisotropy is decreased when the reduction ratio of the cold rolling is increased. In view of these points, the reduction ratio of the cold rolling should exceed about 60%. These characteristics are degraded, however, when the reduction ratio exceeds about 95%. The reduction ratio of the cold rolling, therefore, is preferably in the range of about 60–95%.

Finish annealing

The finish annealing of the cold rolled sheet is essential for the isotropy and uniformity of crystal grains and for the purpose of securing good mechanical properties. Preferably, the range of finish annealing temperature is about 830°–950° C., and the retention time is in the range of about 3 seconds–1 minute.

EXAMPLES

The invention will now be described through illustrative examples. The examples are not intended to limit the scope of the appended claims.

Species of steel differing in chemical composition as shown in Table 1 (part 1-(a) to part 3-(b) were each melted and refined in a converter, cast in the shape of a slab, then heated to 1250° C., and hot rolled under production condition No. 1 shown in Table 2 by four passes of rough rolling and seven passes of finish rolling. The hot-rolled sheets were annealed (retention time: 1 minute), pickled, then cold rolled, and finish annealed (retention time: 30 seconds) to obtain cold-rolled steel sheets having a thickness of 0.6 mm.

TABLE 1

1-(a)

| Steel No. | C | Si | Mn | P | S | Cr | Mo | Al | Ti | N | Remarks (Ex. = Example) |
|---|---|---|---|---|---|---|---|---|---|---|---|
| 1 | 0.003 | 0.05 | 0.30 | 0.025 | 0.001 | 17.5 | 1.5 | 0.051 | 0.165 | 0.008 | Ex. of Invention |
| 2 | 0.002 | 0.10 | 0.25 | 0.031 | 0.002 | 18.0 | 0.001 | 0.101 | 0.180 | 0.009 | Ex. of Invention |
| 3 | 0.018 | 0.11 | 0.25 | 0.028 | 0.001 | 17.3 | 0.3 | 0.103 | 0.455 | 0.020 | Comparative Ex. |
| 4 | 0.001 | 0.07 | 0.31 | 0.030 | 0.002 | 17.5 | 0.4 | 0.053 | 0.039 | 0.002 | Comparative Ex. |
| 5 | 0.004 | 0.40 | 0.25 | 0.033 | 0.003 | 17.3 | 0.001 | 0.006 | 0.112 | 0.004 | Comparative Ex. |
| 6 | 0.015 | 0.55 | 0.33 | 0.024 | 0.003 | 17.5 | 0.3 | 0.005 | 0.286 | 0.005 | Comparative Ex. |
| 7 | 0.005 | 0.09 | 0.23 | 0.023 | 0.003 | 17.4 | 1.0 | 0.05 | 0.174 | 0.008 | Comparative Ex. |
| 8 | 0.004 | 0.08 | 0.25 | 0.023 | 0.004 | 17.5 | 1.5 | 0.08 | 0.006 | 0.008 | Comparative Ex. |
| 9 | 0.003 | 0.09 | 0.29 | 0.025 | 0.004 | 17.8 | 1.3 | 0.11 | 0.343 | 0.006 | Comparative Ex. |
| 10 | 0.008 | 0.12 | 0.31 | 0.033 | 0.004 | 18.0 | 0.2 | 0.08 | 0.280 | 0.015 | Ex. of Invention |

1-(b)

| Steel No. | C + N | C/N | Ti/(C + N) | O | Nb | Ca | B | Cu | Ni | Remarks (Ex. = Example) |
|---|---|---|---|---|---|---|---|---|---|---|
| 1 | 0.011 | 0.38 | 15.00 | 0.007 | — | — | — | — | — | Ex. of Invention |
| 2 | 0.011 | 0.22 | 16.36 | 0.007 | 0.0031 | 0.0010 | 0.0011 | — | — | Ex. of Invention |
| 3 | 0.038 | 0.90 | 11.97 | 0.009 | — | 0.0011 | 0.0010 | — | — | Comparative Ex. |
| 4 | 0.003 | 0.50 | 13.00 | 0.009 | 0.0025 | 0.0009 | 0.0010 | — | — | Comparative Ex. |
| 5 | 0.008 | 1.00 | 14.00 | 0.007 | — | — | — | — | — | Comparative Ex. |
| 6 | 0.02 | 3.00 | 14.30 | 0.008 | — | 0.0011 | 0.0010 | — | — | Comparative Ex. |
| 7 | 0.013 | 0.63 | 13.38 | 0.007 | 0.0025 | 0.0013 | — | — | — | Comparative Ex. |

TABLE 1-continued

| | | | | | | | | | | |
|---|---|---|---|---|---|---|---|---|---|---|
| 8 | 0.012 | 0.50 | 0.50 | 0.011 | 0.0021 | 0.0011 | 0.0009 | — | — | Comparative Ex. |
| 9 | 0.009 | 0.50 | 38.11 | 0.005 | — | — | — | — | — | Comparative Ex. |
| 10 | 0.023 | 0.53 | 12.17 | 0.008 | 0.0025 | 0.0011 | 0.0012 | — | — | Ex. of Invention |

2-(a)

| Steel No. | C | Si | Mn | P | S | Cr | Mo | Al | Ti | N | Remarks (Ex. = Example) |
|---|---|---|---|---|---|---|---|---|---|---|---|
| 11 | 0.001 | 0.08 | 0.41 | 0.030 | 0.002 | 18.1 | 0.3 | 0.11 | 0.143 | 0.008 | Ex. of Invention |
| 12 | 0.003 | 0.11 | 0.30 | 0.025 | 0.002 | 17.3 | 1.5 | 0.08 | 0.142 | 0.006 | Ex. of Invention |
| 13 | 0.004 | 0.15 | 0.031 | 0.022 | 0.002 | 12.0 | 1.3 | 0.11 | 0.167 | 0.010 | Ex. of Invention |
| 14 | 0.004 | 0.11 | 0.030 | 0.020 | 0.002 | 30.1 | 1.5 | 0.03 | 0.306 | 0.010 | Ex. of Invention |
| 15 | 0.004 | 0.10 | 0.031 | 0.020 | 0.001 | 20.1 | 1.2 | 0.09 | 0.105 | 0.008 | Ex. of Invention |
| 16 | 0.010 | 0.08 | 0.028 | 0.022 | 0.001 | 18.1 | 1.5 | 0.02 | 0.044 | 0.021 | Comparative Ex. |
| 17 | 0.003 | 0.06 | 0.28 | 0.025 | 0.002 | 17.2 | 1.38 | 0.101 | 0.010 | 0.006 | Comparative Ex. |
| 18 | 0.002 | 0.09 | 0.31 | 0.033 | 0.004 | 17.4 | 1.51 | 0.05 | 0.159 | 0.007 | Ex. of Invention |
| 19 | 0.003 | 0.11 | 0.40 | 0.032 | 0.003 | 17.5 | 1.49 | 0.08 | 0.218 | 0.008 | Ex. of Invention |
| 20 | 0.003 | 0.06 | 0.28 | 0.023 | 0.001 | 17.8 | 1.45 | 0.045 | 0.170 | 0.007 | Ex. of Invention |

2-(b)

| Steel No. | C + N | C/N | Ti/(C + N) | O | Nb | Ca | B | Cu | Ni | Remarks (Ex. = Example) |
|---|---|---|---|---|---|---|---|---|---|---|
| 11 | 0.009 | 0.13 | 15.89 | 0.007 | 0.0020 | — | — | — | — | Ex. of Invention |
| 12 | 0.009 | 0.50 | 15.78 | 0.009 | — | 0.0011 | — | — | — | Ex. of Invention |
| 13 | 0.014 | 0.40 | 11.93 | 0.015 | 0.0015 | 0.0010 | 0.0013 | — | — | Ex. of Invention |
| 14 | 0.014 | 0.40 | 21.86 | 0.011 | 0.0030 | 0.0015 | 0.0012 | — | — | Ex. of Invention |
| 15 | 0.012 | 0.50 | 8.75 | 0.010 | 0.0061 | 0.0011 | 0.0009 | — | — | Ex. of Invention |
| 16 | 0.031 | 0.48 | 1.42 | 0.011 | 0.0025 | 0.0009 | 0.0008 | — | — | Comparative Ex. |
| 17 | 0.009 | 0.50 | 1.11 | 0.008 | 0.0031 | 0.0018 | 0.0015 | — | — | Comparative Ex. |
| 18 | 0.009 | 0.29 | 17.67 | 0.011 | 0.0020 | 0.0009 | 0.0018 | — | — | Ex. of Invention |
| 19 | 0.011 | 0.38 | 19.82 | 0.009 | 0.0025 | 0.0013 | 0.0011 | — | — | Ex. of Invention |
| 20 | 0.010 | 0.43 | 17.00 | 0.006 | — | — | 0.0009 | — | — | Ex. of Invention |

3-(a)

| Steel No. | C | Si | Mn | P | S | Cr | Mo | Al | Ti | N | Remarks (Ex. = Example) |
|---|---|---|---|---|---|---|---|---|---|---|---|
| 21 | 0.004 | 0.15 | 0.31 | 0.026 | 0.002 | 18.1 | 1.51 | 0.059 | 0.183 | 0.007 | Ex. of Invention |
| 22 | 0.004 | 0.11 | 0.35 | 0.025 | 0.002 | 18.1 | 1.50 | 0.061 | 0.171 | 0.006 | Ex. of Invention |
| 23 | 0.003 | 0.23 | 0.13 | 0.031 | 0.003 | 17.9 | 1.23 | 0.13 | 0.151 | 0.007 | Ex. of Invention |
| 24 | 0.003 | 0.18 | 0.15 | 0.020 | 0.002 | 16.3 | 1.51 | 0.045 | 0.200 | 0.008 | Ex. of Invention |
| 25 | 0.004 | 0.07 | 0.13 | 0.029 | 0.001 | 18.9 | 1.51 | 0.039 | 0.191 | 0.009 | Ex. of Invention |
| 26 | 0.002 | 0.09 | 0.26 | 0.023 | 0.002 | 18.1 | 1.39 | 0.50 | 0.198 | 0.007 | Ex. of Invention |
| 27 | 0.004 | 0.11 | 0.31 | 0.019 | 0.003 | 17.0 | 1.70 | 0.049 | 0.203 | 0.009 | Ex. of Invention |
| 28 | 0.003 | 0.09 | 0.25 | 0.022 | 0.002 | 18.3 | 1.44 | 0.044 | 0.179 | 0.009 | Ex. of Invention |
| 29 | 0.003 | 0.15 | 0.28 | 0.030 | 0.003 | 16.9 | 0.3 | 0.041 | 0.220 | 0.007 | Ex. of Invention |

3-(b)

| Steel No. | C + N | C/N | Ti/(C + N) | O | Nb | Ca | B | Cu | Ni | Remarks (Ex. = Example) |
|---|---|---|---|---|---|---|---|---|---|---|
| 21 | 0.011 | 0.57 | 16.64 | 0.004 | — | — | — | 0.20 | — | Ex. of Invention |
| 22 | 0.010 | 0.67 | 17.10 | 0.005 | — | — | — | — | 0.15 | Ex. of Invention |
| 23 | 0.010 | 0.43 | 15.10 | 0.009 | — | — | — | 0.10 | 0.09 | Ex. of Invention |
| 24 | 0.011 | 0.38 | 18.18 | 0.008 | 0.0031 | 0.0010 | — | — | — | Ex. of Invention |
| 25 | 0.013 | 0.44 | 14.69 | 0.006 | 0.0025 | — | 0.0012 | — | — | Ex. of Invention |
| 26 | 0.009 | 0.29 | 22.00 | 0.007 | 0.0048 | — | — | 0.11 | 0.06 | Ex. of Invention |
| 27 | 0.013 | 0.44 | 15.62 | 0.007 | 0.0030 | 0.0018 | 0.0013 | 0.28 | 0.09 | Ex. of Invention |
| 28 | 0.012 | 0.33 | 14.92 | 0.006 | 0.0015 | 0.0021 | 0.0011 | 0.20 | 0.20 | Ex. of Invention |
| 29 | 0.010 | 0.43 | 22.00 | 0.007 | — | — | — | — | — | Ex. of Invention |

TABLE 2

| Production condition No. | Final pass reduction ratio during rough rolling (%) | Final temperature for finishing roll (°C.) | Annealing temperature of hot rolling (°C.) | Total reduction ratio for cold rolling (%) | Finish annealing (°C.) | Remarks (Ex. = Example) |
|---|---|---|---|---|---|---|
| 1 | 43 | 721 | 1048 | 85 | 920 | Ex. of Invention |
| 2 | 30 | 725 | 145 | 85 | 920 | Comparative Ex. |

TABLE 2-continued

| Production condition No. | Final pass reduction ratio during rough rolling (%) | Final temperature for finishing roll (°C.) | Annealing temperature of hot rolling (°C.) | Total reduction ratio for cold rolling (%) | Finish annealing (°C.) | Remarks (Ex. = Example) |
|---|---|---|---|---|---|---|
| 3 | 45 | 810 | 1040 | 85 | 915 | Comparative Ex. |
| 4 | 30 | 822 | 1040 | 85 | 900 | Comparative Ex. |
| 5 | 45 | 730 | 850 | 85 | 910 | Comparative Ex. |
| 6 | 43 | 721 | 1115 | 85 | 915 | Comparative Ex. |
| 7 | 47 | 738 | 1022 | 85 | 800 | Comparative Ex. |
| 8 | 44 | 700 | 1030 | 75 | 980 | Comparative Ex. |
| 9 | 25 | 798 | 1000 | 85 | 905 | Comparative Ex. |
| 10 | 45 | 680 | 1020 | 85 | 900 | Ex. of Invention |
| 11 | 45 | 620 | 1035 | 85 | 880 | Ex. of Invention |

In each of the cold-rolled steel sheets obtained by the method described above, the X-ray integral intensity ratio α was found by the X-ray diffraction method at a depth of ¼ of the sheet thickness to determine elongation (El), deep-drawing formability (r value), ΔEl, Δr, anti-ridging characteristics, and biaxial stretch forming (Erichsen value). By the method described above, the thickness proportion of the sheet which possesses an a within about ±40% of the average α in the sheet thickness direction was calculated. To study the aggregation texture in a hot-rolled sheet, the ratio of α was determined at a depth of ¼ of the sheet thickness. The results are shown in Table 3.

Some of the steels shown in Table 1 were combined as shown in Table 4 under production conditions shown in Table 2 and processed in the same manner as described above to produce cold-rolled steel sheets, 0.6 mm in thickness. These steel sheets were similarly tested. The results are shown in Table 4.

TABLE 3

| Steel No. | El (%) | ΔE1 (%) | r value | Δr | Erichsen value | Undulating height (μm) | α = (222)/(310) Hot roll sheet | α = (222)/(310) Cold roll sheet | Thickness proportion within ±40% of thickness average of α (%) | Remarks (Ex. = Example) |
|---|---|---|---|---|---|---|---|---|---|---|
| 1 | 33.1 | 1.5 | 1.58 | 0.08 | 11.5 | 5.8 | 56 | 70 | 85 | Ex. of Invention |
| 2 | 34.2 | 1.2 | 1.63 | 0.05 | 12.3 | 4.4 | 70 | 91 | 81 | Ex. of Invention |
| 3 | 29.3 | 2.1 | 1.43 | 0.21 | 9.4 | 2.1 | 16 | 20 | 58 | Comparative Ex. |
| 4 | 36.1 | 2.8 | 1.71 | 0.38 | 12.1 | 2.3 | 21 | 27 | 60 | Comparative Ex. |
| 5 | 33.0 | 2.2 | 1.53 | 0.23 | 11.2 | 12.1 | 1 | 8 | 51 | Comparative Ex. |
| 6 | 31.0 | 3.4 | 1.51 | 0.33 | 10.8 | 14.3 | 0.6 | 0.8 | 42 | Comparative Ex. |
| 7 | 32.1 | 2.2 | 1.53 | 0.28 | 11.0 | 9.8 | 10 | 13 | 59 | Comparative Ex. |
| 8 | 29.8 | 1.7 | 1.33 | 0.15 | 9.8 | 5.1 | 2.4 | 3.5 | 55 | Comparative Ex. |
| 9 | 30.3 | 2.1 | 1.41 | 0.18 | 10.2 | 4.7 | 18 | 22 | 63 | Comparative Ex. |
| 10 | 32.5 | 1.7 | 1.53 | 0.13 | 11.1 | 5.4 | 30 | 40 | 83 | Ex. of Invention |
| 11 | 35.3 | 0.7 | 1.68 | 0.03 | 12.5 | 3.4 | 104 | 130 | 85 | Ex. of Invention |
| 12 | 32.1 | 1.8 | 1.51 | 0.15 | 10.8 | 5.3 | 43 | 55 | 80 | Ex. of Invention |
| 13 | 32.4 | 1.6 | 1.55 | 0.14 | 11.0 | 4.7 | 70 | 90 | 83 | Ex. of Invention |
| 14 | 31.3 | 1.3 | 1.52 | 0.12 | 10.8 | 6.1 | 54 | 68 | 81 | Ex. of Invention |
| 15 | 33.8 | 1.9 | 1.53 | 0.08 | 12.1 | 6.0 | 51 | 67 | 82 | Ex. of Invention |
| 16 | 27.3 | 3.2 | 1.19 | 0.35 | 9.1 | 4.2 | 9.5 | 18 | 38 | Comparative Ex. |
| 17 | 27.0 | 3.0 | 1.13 | 0.31 | 9.2 | 4.3 | 9.0 | 19 | 42 | Comparative Ex. |
| 18 | 33.3 | 1.4 | 1.59 | 0.07 | 11.3 | 5.0 | 70 | 88 | 83 | Ex. of Invention |
| 19 | 33.4 | 1.3 | 1.59 | 0.09 | 11.4 | 5.0 | 63 | 80 | 85 | Ex. of Invention |
| 20 | 34.1 | 1.7 | 1.61 | 0.15 | 11.8 | 4.8 | 62 | 81 | 82 | Ex. of Invention |
| 21 | 32.5 | 1.5 | 1.59 | 0.13 | 11.0 | 5.3 | 55 | 71 | 85 | Ex. of Invention |
| 22 | 33.3 | 1.8 | 1.70 | 0.16 | 11.5 | 5.5 | 50 | 71 | 86 | Ex. of Invention |
| 23 | 33.4 | 1.7 | 1.59 | 0.15 | 11.5 | 5.7 | 55 | 63 | 87 | Ex. of Invention |
| 24 | 32.9 | 1.3 | 1.62 | 0.09 | 11.3 | 5.9 | 54 | 79 | 83 | Ex. of Invention |
| 25 | 34.5 | 1.2 | 1.68 | 0.08 | 12.1 | 5.0 | 60 | 80 | 83 | Ex. of Invention |
| 26 | 33.3 | 0.9 | 1.63 | 0.11 | 11.0 | 5.8 | 57 | 80 | 84 | Ex. of Invention |
| 27 | 32.8 | 1.3 | 1.63 | 0.09 | 11.5 | 6.1 | 48 | 69 | 85 | Ex. of Invention |
| 28 | 33.4 | 1.1 | 1.63 | 0.16 | 10.9 | 5.5 | 51 | 70 | 83 | Ex. of Invention |
| 29 | 33.0 | 1.5 | 1.58 | 0.17 | 11.3 | 6.3 | 43 | 59 | 83 | Ex. of Invention |

TABLE 4

| Steel No. | Production condition No. | El (%) | ΔEl (%) | r value | Δr | Erichsen value | Undulating height (μm) | α = (222)/(310) Hot roll sheet | α = (222)/(310) Cold roll sheet | Thickness proportion within ±40% of thickness average of α (%) | Remarks (Ex. = Example) |
|---|---|---|---|---|---|---|---|---|---|---|---|
| 1 | 1 | 33.1 | 1.5 | 1.58 | 0.08 | 11.5 | 5.8 | 56 | 70 | 85 | Ex. of Invention |
| 1 | 2 | 32.5 | 1.3 | 1.48 | 0.11 | 10.3 | 25.2 | 18 | 25 | 63 | Comparative Ex. |
| 1 | 3 | 32.3 | 1.3 | 1.51 | 0.13 | 10.3 | 18.3 | 16 | 22 | 68 | Comparative Ex. |
| 1 | 4 | 30.3 | 1.0 | 1.38 | 0.29 | 9.9 | 12.3 | 6 | 8 | 50 | Comparative Ex. |
| 1 | 5 | 31.3 | 1.2 | 1.51 | 0.09 | 10.3 | 17.2 | 16 | 21 | 83 | Comparative Ex. |
| 1 | 6 | 33.9 | 2.9 | 1.53 | 0.11 | 11.5 | 8.8 | 9 | 13 | 55 | Comparative Ex. |
| 1 | 7 | 22.5 | 1.3 | 1.40 | 0.33 | 9.5 | 8.3 | 38 | 48 | 82 | Comparative Ex. |
| 1 | 8 | 34.1 | 1.9 | 1.58 | 0.13 | 11.0 | 28.3 | 39 | 52 | 85 | Comparative Ex. |
| 1 | 9 | 32.5 | 1.3 | 1.38 | 0.11 | 11.2 | 7.1 | 17 | 18 | 43 | Comparative Ex. |
| 1 | 10 | 33.3 | 1.2 | 1.60 | 0.08 | 11.3 | 5.2 | 67 | 83 | 85 | Ex. of Invention |
| 1 | 11 | 32.9 | 1.3 | 1.59 | 0.05 | 11.2 | 5.5 | 70 | 88 | 88 | Ex. of Invention |
| 2 | 1 | 34.3 | 1.2 | 1.71 | 0.05 | 13.2 | 7.0 | 66 | 83 | 84 | Ex. of Invention |
| 3 | 1 | 32.1 | 1.5 | 1.63 | 0.11 | 12.1 | 14.1 | 40 | 50 | 60 | Comparative Ex. |
| 3 | 2 | 30.3 | 2.1 | 1.40 | 0.33 | 10.3 | 12.1 | 40 | 48 | 58 | Comparative Ex. |
| 3 | 4 | 32.3 | 2.3 | 1.58 | 0.25 | 10.2 | 11.0 | 48 | 63 | 47 | Comparative Ex. |
| 3 | 3 | 30.3 | 2.1 | 1.51 | 0.31 | 11.3 | 13.4 | 32 | 42 | 65 | Comparative Ex. |
| 10 | 1 | 32.5 | 1.7 | 1.52 | 0.13 | 11.1 | 5.4 | 30 | 48 | 80 | Ex. of Invention |
| 11 | 1 | 35.3 | 0.7 | 1.68 | 0.03 | 12.5 | 3.4 | 104 | 136 | 85 | Ex. of Invention |
| 18 | 1 | 32.1 | 1.8 | 1.51 | 0.15 | 10.8 | 5.3 | 43 | 55 | 83 | Ex. of Invention |
| 20 | 10 | 34.1 | 1.7 | 1.61 | 0.15 | 11.0 | 4.8 | 62 | 81 | 82 | Ex. of Invention |
| 21 | 10 | 32.4 | 1.5 | 1.59 | 0.13 | 11.0 | 5.3 | 55 | 71 | 85 | Ex. of Invention |
| 22 | 11 | 33.3 | 1.8 | 1.70 | 0.16 | 11.5 | 5.5 | 50 | 71 | 86 | Ex. of Invention |
| 23 | 11 | 33.4 | 1.7 | 1.59 | 0.15 | 11.5 | 5.7 | 55 | 63 | 87 | Ex. of Invention |
| 24 | 1 | 32.9 | 1.3 | 1.62 | 0.09 | 11.3 | 5.9 | 54 | 79 | 83 | Ex. of Invention |
| 25 | 1 | 34.5 | 1.3 | 1.68 | 0.08 | 12.1 | 5.0 | 60 | 80 | 83 | Ex. of Invention |
| 26 | 1 | 33.3 | 0.9 | 1.63 | 0.11 | 11.0 | 5.8 | 57 | 80 | 84 | Ex. of Invention |
| 27 | 1 | 32.8 | 1.3 | 1.63 | 0.09 | 11.5 | 6.1 | 48 | 69 | 85 | Ex. of Invention |
| 28 | 1 | 33.4 | 1.1 | 1.63 | 0.16 | 10.9 | 5.5 | 51 | 70 | 83 | Ex. of Invention |
| 29 | 1 | 33.0 | 1.5 | 1.58 | 0.17 | 11.3 | 6.3 | 43 | 59 | 83 | Ex. of Invention |

The properties mentioned above were measured by the following methods.

El, ΔEl r value, and Δr

From a given steel sheet, test pieces in accordance with No. 13B of JIS (Japanese Industrial Standard) were taken in a direction of 45° relative to the direction of rolling and in a direction of 90° relative to the direction of rolling. The test pieces were subjected to a tensile test to determine elongation at rupture. From the test results, El and ΔEl were calculated based on the following formulas:

$$El=(El_L+2El_D+El_T)/4$$

$$\Delta El=(El_L-2El_D+El_T)/2.$$

In the formulas, $El_L$ represents elongation at rupture in the rolling direction, $El_D$ represents elongation at rupture in a direction 45° relative to the rolling direction, and $El_T$ represents elongation at rupture in a direction 90° relative to the rolling direction.

Test pieces in accordance with No. 13B of JIS, taken in varying directions in the same manner as described above, were uniaxially stretched to 5–15%. From the ratio of lateral strain and strain in the direction of sheet thickness thusly obtained, the Rankford values were determined in the relevant directions and the r value and the Δr were calculated based on the following formulas:

$$r=(r_L+2r_D+r_T)/4$$

$$\delta r=(r_L-2r_D+r_T)/2.$$

In the formulas, $r_L$ represents Rankford value in the rolling direction, $r_D$ represents the Rankford value in a direction 45° relative to the rolling direction, and $r_T$ represents the Rankford value in a direction 90° relative to the rolling direction.

Erichsen value

This was determined in accordance with method 2247 of JIS, using a sample coated with graphite grease.

Undulating height (irregularities in ridging)

The undulating height was measured by producing a ridge in a sample through a tensile test, measuring irregularities perpendicular to the stretching direction by the use of a roughness meter, and calculating the average of the differences in wave heights from the results of the measurement mentioned above. The undulating height was determined by polishing one surface of a tensile test piece prepared in accordance with No. 5 of JIS until a wet 600 finish was attained, then stretching the test piece by 20% at room temperature, evaluating the produced ridge by measuring perpendicular to the stretching direction by the use of a roughness meter, and calculating the average of the measurements.

As seen from the tabulated results, a ferritic stainless steel sheet having an El of not less than 30%, a ΔEl of not more than 2.0%, a r value of not less than 1.4, a Δr of not more than 0.2, an Erichsen value of not less than 10, and an undulating height of not more than 10 μm, possessing satisfactory formability, manifesting less planar anisotropy, and excelling in anti-ridging characteristics can be produced by adjusting the steel composition and the production conditions and controlling the a value of the cold-rolled sheet in accordance with the invention.

As described above, this invention enables the production of a ferritic stainless steel sheet possessing satisfactory formability and, at the same time, exhibiting less planar anisotropy and excelling in anti-ridging characteristics. By this invention, a ferritic stainless steel sheet having an elongation of not less than 30%, a r value of not less than 1.4, a planar anisotropy of elongation, ΔEl of not more than 2.0%, a planar anisotropy of r value, Δr, of not more than 0.2, and a anti-ridging characteristics of not more than 10 μm in undulating height can be produced. The ferritic stainless steel sheets produced according to this invention, therefore, can be used in various applications which have heretofore required the use of austenitic stainless steel sheets. As a result, this invention has very high commercial value.

It should be understood that the scope of the invention is not limited to the particular illustrative embodiments shown and described herein, but that various equivalent elements and method steps may be substituted without departing from the spirit and scope of the invention defined in the appended claims.

What is claimed is:

1. An enhanced ferritic stainless steel plate having less planar anisotropy and excellent anti-ridging characteristics comprising:

not more than about 0.02 wt % of C, about 0.01–1.0 wt % of Si, about 0.01–1.0 wt % of Mn, not more than about 0.08 wt % of P, not more than about 0.01 wt % of S, about 0.005–0.30 wt % of Al, about 11–50 wt % of Cr, about 0.1–5.0 wt % of Mo, not more than about 0.03 wt % N, the content of elements C and N further satisfying the relationship:

about 0.005 wt %≦(C+N)≦about 0.03 wt %, and (C/N) <about 0.6, said sheet further comprising Ti in an amount which satisfies the relation:

about 5≦Ti/(C+N)≦about 30, the balance of said sheet comprising Fe and incidental impurities, said sheet having an X-ray integral intensity ratio (222)/(310) of not less than about 35 in a plane parallel to a sheet surface at a depth of about ¼ of the sheet thickness from said sheet surface, and having an elongation of not less than 30%, an r value of not less than 1.4, a planar anisotropy of elongation, ΔEl, of not more than 2.0%, a planar anisotropy of r value, Δr, of not more than 0.2, and anti-ridging characteristics of not more than 10 μm in undulating height, further comprising at least one member of at least one group selected from the following four groups:

(1) Ca: about 0.0005–0.0050 wt %, (2) Nb: about 0.001–0.0100 wt %, (3) Cu: about 0.01–2.0 wt %, (4) Ni: about 0.01–2.0 wt %, and further comprising as an essential element 0.0002–0.0020 wt % B.

2. The ferritic stainless steel sheet according to claim 1, further comprising an X-ray integral intensity ratio (222)/(310) over at least about 80% of said sheet thickness within about ±40% of an average X-ray integral intensity ratio (222)/(310) in the sheet thickness direction.

* * * * *

UNITED STATES PATENT AND TRADEMARK OFFICE

CERTIFICATE OF CORRECTION

PATENT NO. : 5,851,316
DATED : December 22, 1998
INVENTOR(S) : Yazawa, et al

It is certified that error appears in the above-identified patent and that said Letters Patent is hereby corrected as shown below:

In Column 4, at line 8, please change "a" to --σ--.

In Column 6, at line 15, please change "a" to --α--; and at line 40, please change "a" to --α--.

In Column 10, at table "3-(a)" at the subheading "A1", line 6, please change "0.50" to --0.050--.

In Column 11, at line 25, please change "a" to --α--; and at table 3, at the subheading "E1 (%)", line 21, please change "32.5" to --32.4--.

UNITED STATES PATENT AND TRADEMARK OFFICE

CERTIFICATE OF CORRECTION

PATENT NO. : 5,851,316

DATED : Dec. 22, 1998

INVENTOR(S) : Yazawa, et al

It is certified that error appears in the above-identified patent and that said Letters Patent is hereby corrected as shown below:

In Column 14, at table 4, at the subheading "Hot roll sheet", at line 9, please change "17" to --17--; at the subheading "Cold roll sheet", at line 9, please change "18" to --18--; at the subheading "average of α (%)", at line 9, please change "43" to --43--.

Also, in Column 14, line 63, please change "a" to --α--.

Signed and Sealed this

Tenth Day of August, 1999

*Attest:*

Q. TODD DICKINSON

*Attesting Officer*

*Acting Commissioner of Patents and Trademarks*